US005494237A

United States Patent [19]

Summey, III

[11] Patent Number: 5,494,237

[45] Date of Patent: Feb. 27, 1996

[54] OSCILLATABLE WEB GUIDE ROLL AND METHOD OF WINDING

[75] Inventor: Shala W. Summey, III, Greenville, S.C.

[73] Assignee: Alexander Machinery, Inc., Mauldin, S.C.

[21] Appl. No.: 222,020

[22] Filed: Apr. 4, 1994

[51] Int. Cl.[6] ..... B65M 23/038

[52] U.S. Cl. ..... 242/548.1; 226/190

[58] Field of Search ..... 242/542, 548, 242/548.1, 548.2, 548.3; 226/190, 192

[56] References Cited

U.S. PATENT DOCUMENTS

| | | | |
|---|---|---|---|
| 2,353,653 | 7/1944 | Croft et al. | 242/548.1 |
| 4,175,689 | 11/1979 | Parker | 226/190 |
| 4,216,804 | 8/1980 | Alexander, III et al. | 242/542 |
| 4,252,154 | 2/1981 | Alexander, III | 242/548.1 |
| 4,390,139 | 6/1983 | Alexander, III | 242/548.1 |
| 4,763,852 | 8/1988 | Smith | 242/548.1 |
| 4,829,645 | 5/1989 | Kannwischer | 226/190 |
| 5,259,562 | 11/1993 | Smart et al. | 242/548 |
| 5,314,128 | 5/1994 | Alexander, III | 242/542 |

*Primary Examiner*—John P. Darling
*Attorney, Agent, or Firm*—Ralph Bailey

[57] ABSTRACT

An oscillatable web guide roll and method of winding uses a cylindrical roll (A) with as recess at one end for receiving a cylindrical cam (C) upon a shaft which forms part of a mounting (B) for the cylindrical roll so that a cam follower (D) fixed to the cylindrical roll may be positively guided by the cam to produce oscillatory movement of the cylindrical roll (A) thus oscillating the web along its longitudinal axis during the building of the web roll.

5 Claims, 2 Drawing Sheets

OSCILLATABLE WEB GUIDE ROLL AND METHOD OF WINDING

BACKGROUND OF THE INVENTION

This invention relates to an improvement in oscillatable web guide rolls such as illustrated in U.S. Pat. Nos. 4,252,154 and 4,390,139 and to a method of winding.

Oscillating guide rolls constructed in accordance with the prior art require either a mechanical linkage to effect an oscillatory movement of the roll or a cam within each end of the guide roll for initiating the required oscillatory movement. These constructions are complicated and expensive from a mechanical standpoint both in the manufacture and use of the oscillatable rolls. A particular problem concerns the fact the prior art guide rolls are difficult to adjust, either requiring different cam and linkage mechanisms or an exchange of cams at both ends of the guide roll in order to effect the adjustment.

Because of the complexity of such prior art, oscillating rolls considerable expense is incurred in maintaining satisfactory operation of the rolls. The wear upon the linkage and the lack of a positive connection in the case of the double cam arrangement result in inefficient operation in that the resulting web roll may retain defects.

SUMMARY OF THE INVENTION

Accordingly, it is an important object of the present invention to provide an oscillatable guide roll and method of winding wherein thickened portions of a web either at the edges or otherwise do not stack over one another as the winding progresses producing the irregularities in the web with resulting damage to the web.

Another important object of the invention is to provide a single cam means located at one end of the oscillating roll which will contain no moving parts and be positive in its operation for effecting efficient oscillations of the web during the build.

Another object of the invention is to provide an improved camming apparatus and method for winding which is especially useful for winding cloth wherein thick selvage areas are moved back and forth so as not to stack upon themselves during winding.

Another important object of the invention is to provide a cylindrical cam insertable at one end of the oscillatable roll wherein a cam follower carried in fixed relation to the roll may positively follow a cam surface resulting in controlled oscillatory movement of the roll.

While the invention is especially useful in connection with oscillating rolls for winding cloth coming from a loom, it is to be understood that other applications may be made as in winding other web material such as paper or plastic sheets.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3 is an enlarged front elevation of the right hand side of the roll in FIG. 2 with parts broken away and parts in section illustrating camming apparatus constructed in accordance with the present invention.

DESCRIPTION OF A PREFERRED EMBODIMENT

Figure 1:
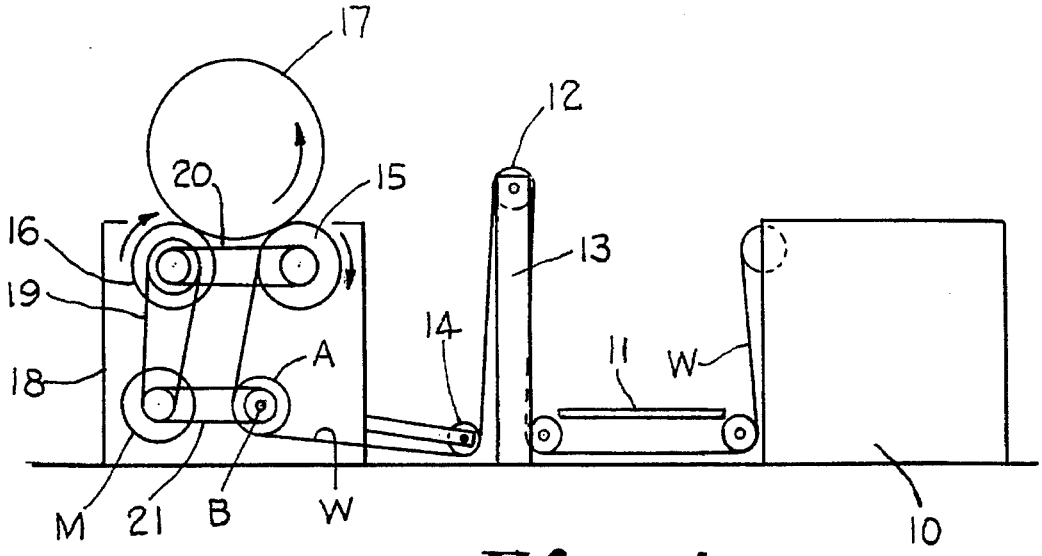
FIG. 1 is a schematic side elevation illustrating an oscillatable guide roll constructed in accordance with the present invention upon a surface winder receiving cloth from a loom after passing over inspection apparatus.

The drawings illustrate an oscillatable guide roll for use in winding cloth from a loom into a cloth roll. A cylindrical roll A has a receptacle on at least one end. Means B are provided for mounting the cylindrical roll for rotation while guiding the web passing over in engagement with a periphery thereof for rotating same. A cylindrical cam member C fixed against longitudinal oscillatory movement is carried by the receptacle and has a cam track thereon. A cam follower D is fixed on the cylindrical roll for movement in a cam track producing longitudinal oscillatory sliding movement of the cylindrical roll in relation to the cam. Thus, the web is oscillated transversely by the guide roll during the build of the web roll. Referring more particularly to FIG. 1, a loom is illustrated at with cloth W manufactured thereon passing beneath a worker's platform 11 and thence over a guide roll 12 carried at the top of the inspection apparatus 13. The web W is illustrated as passing thence beneath a roll 14 which may be an oscillator roll of the type manufactured in accordance with U.S. Pat. No. 4,216,804.

The web W passes thence about the oscillatable guide roll A to a first roll 15 which together with the roll 16 constitutes support rolls of a surface winder. The web is wound by the support rolls into a cloth or web roll 17. The winder includes a suitable frame 18 which supports a motor M which drives the roll 16 as through any suitable drive such as a drive which includes a chain 19. The roll 16 in turn drives the roll 15 as through a suitable chain 20. The motor M has a suitable drive 21 for driving a sprocket 22 which together with the shaft 23 forms means B which mounts the cylinder roll A for rotation. Preferably, as when winding cloth from a loom on a surface winder as illustrated, the shaft 23 is driven either slightly faster or slower than the drive roll. Preferably, the cylindrical roll oscillates one time per approximately 20 yards of fabric.

Figure 2:
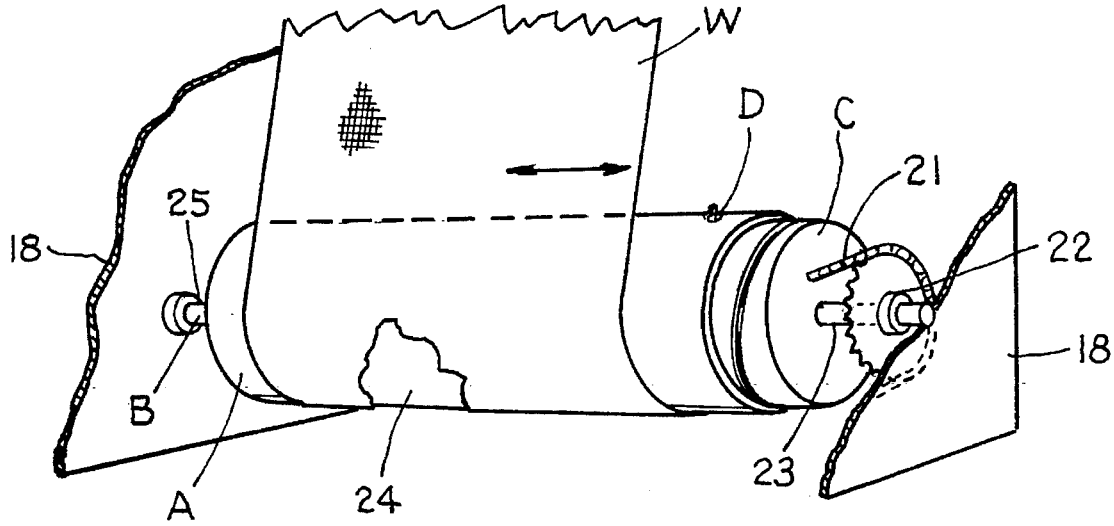
FIG. 2 is an enlarged perspective view looking toward the right hand end of the oscillatable guide roll of FIG. 1.
Figure 5:
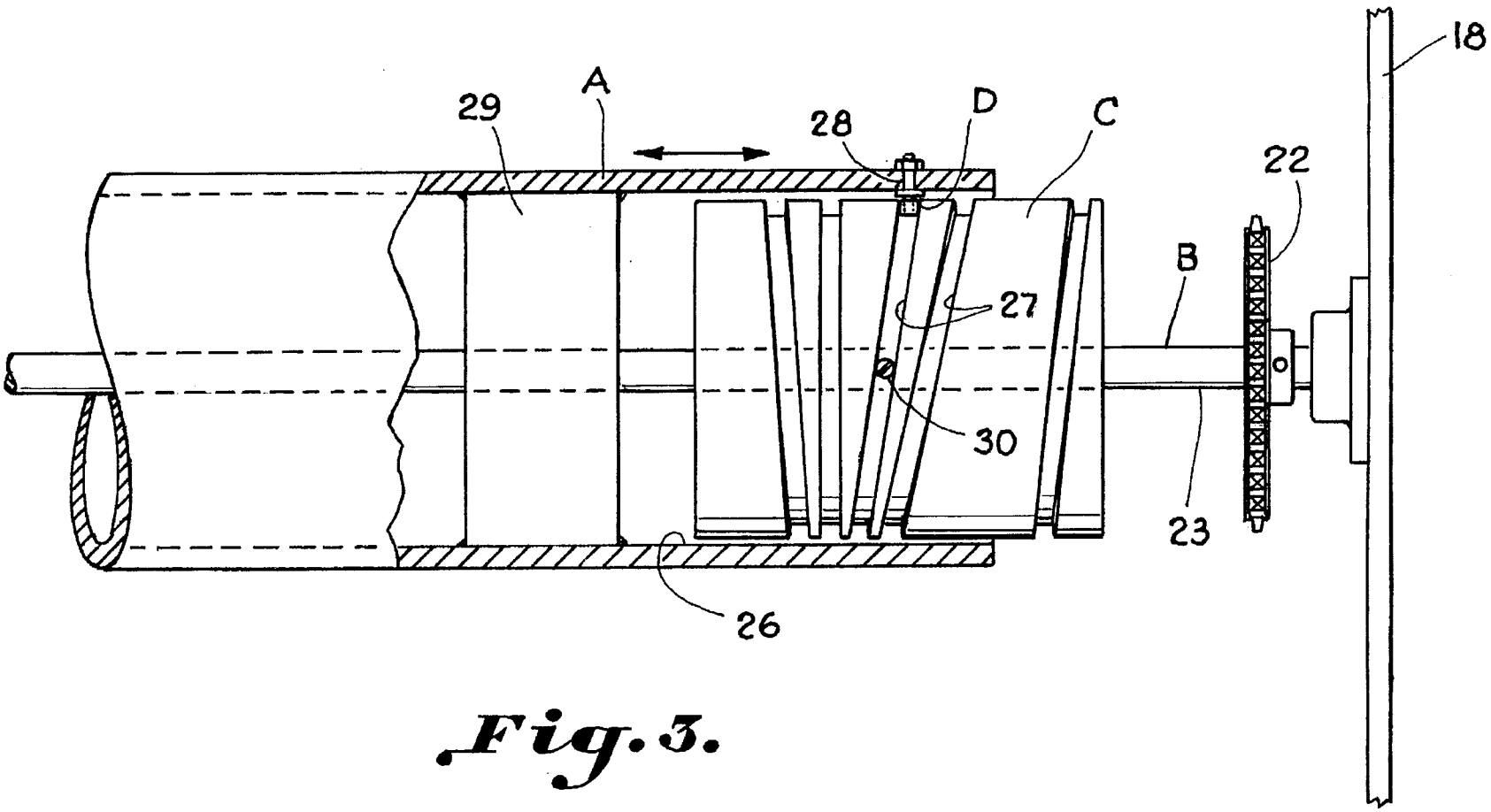

It will be observed by reference to FIG. 2 that a cylindrical cam C is positioned within a recess in an adjacent end of the roll A. At the other end of the roll A a suitable mounting is provided which includes a linear bearing 24 carried upon a shaft 25 which is journaled within the frame 18.

Referring more particularly to FIG. 3, it will be observed that the cylindrical cam member C is carried within a recess 26 at an adjacent end of the roll A. The cylindrical cam C includes a plurality of spaced grooves or cam tracks 27 thereon for receiving a projecting portion 28 of the removable cam follower D which is carried by the cylindrical roll A for producing oscillatory movement in the web in the direction of the arrows. It will be observed that the shaft 23 carries a linear bearing 29 preferably in fixed relation thereon for supporting the cylindrical roll A for sliding oscillatory movement thereon.

The cylindrical cam member C is mounted on the shaft 23 for sliding movement within the recess 26 within the cylindrical roll A. The cylindrical cam is mounted on the shaft 23 for horizontal adjustment by the set screw 30 for varying the extent and location of the oscillatory stroke.

It is thus seen that an improved oscillating roll has been provided which is especially useful in winding cloth wherein a cam mechanism need only be provided at one end of the roll. The cam mechanism thus provided is readily adjustable and positive in its action since a cam follower has fixed connection with the roll and a positive guided relationship with respect to the cylindrical cam.

While a preferred embodiment of the invention has been described using specific terms, such description is for illustrative purposes only, and it is to be understood that changes and variations may be made without departing from the spirit or scope of the following claims.

What is claimed is:

1. An oscillatable guide for use in motor driven apparatus winding a web into a web roll comprising:

a cylindrical guide roll having a receptacle on at least one end;

means mounting said cylindrical guide roll for rotation responsive to movement of said web passing thereover while guiding said web in engagement with a periphery thereof;

a cylindrical cam member carried concentrically within said cylindrical guide roll on said at least one end thereof having a cam track in said cylindrical cam member;

means driving cylindrical cam member for rotation independently of said cylindrical guide roll; and a cam follower carried on said cylindrical guide roll extending in said cam track producing longitudinal oscillatory movement of said cylindrical guide roll as a result of said rotation thereof responsive to movement of said web and said rotation of said cam member;

whereby said web is oscillated by said cylindrical guide roll during build of the web roll as controlled by movement of the web and said means driving said cylindrical cam.

2. The structure set forth in claim 1 including means fixing said cylindrical cam member against longitudinal oscillatory movement and is carried within said receptacle positioning said cylindrical roll for sliding movement thereon and for rotation responsive to said engagement with said web.

3. The structure set forth in claim 2 wherein said cam follower is fixedly carried on said cylindrical roll.

4. The structure set forth in claim 2 including, a shaft, said means fixing said cylindrical cam member being adjustable on said shaft for permitting linear adjustment of said cylindrical cam member thereon, and a linear bearing on said shaft carrying said cylindrical roll for longitudinal oscillation.

5. A method of winding cloth coming from a loom utilizing an oscillatable guide comprising the steps of:

providing a cylindrical roll having a receptacle on at least one end;

mounting the cylindrical roll for rotation responsive to movement of said web passing thereover while guiding said cloth in engagement with a periphery thereof;

mounting a cam member in said receptacle fixed against longitudinal oscillatory movement;

independently rotating said cam member; and fixedly positioning a cam follower upon said cylindrical roll engaging said cam member producing longitudinal oscillatory movement of said cylindrical roll;

whereby the cloth is oscillated by the cylindrical roll during build of the cloth roll as controlled by movement of the web and rotation of said cam member.

* * * * *